United States Patent [19]

Zarlengo et al.

[11] Patent Number: 4,679,351

[45] Date of Patent: Jul. 14, 1987

[54] SECURITY BAR FOR WINDOW OPENING

[76] Inventors: Dominic A. Zarlengo, 3025 W. Scott Pl., Denver, Colo. 80211; Phillip C. Zarlengo, 1379 S. Drexel Way, Lakewood, Colo. 80226

[21] Appl. No.: 874,409

[22] Filed: Jun. 16, 1986

[51] Int. Cl.[4] ..... E06B 3/68

[52] U.S. Cl. ..... 49/57; 403/277

[58] Field of Search ..... 49/56, 57; 403/277, 403/280, 248

[56] References Cited

U.S. PATENT DOCUMENTS

| | | | |
|---|---|---|---|
| 953,197 | 3/1910 | Fox | 49/57 |
| 2,041,162 | 5/1936 | Buckwalter | 403/277 X |
| 4,000,590 | 1/1977 | Kordewick | 49/56 X |
| 4,258,504 | 3/1981 | Hicks | 49/56 |

*Primary Examiner*—Kenneth Downey

*Attorney, Agent, or Firm*—Gary M. Polumbus

[57] ABSTRACT

A protective bar for restricting passage through a window type opening in a building structure includes a tubular member adapted to be seated in a recess provided in one side of the window frame with a spring biased slidable bar protruding from the opposite end of the tubular member and adapted to be seated in a recess provided in the opposite window frame member. A malleable material is utilized to form a seat for the spring which biases the rod axially of the tubular member and the malleable material is positively positioned in place by applying axial compression to the material so that it radially expands into a tight frictional relationship with the internal surface of the tubular member. A pull cable release system is also provided which allows the bar to be quickly and easily removed from a location in the interior of the building structure.

1 Claim, 9 Drawing Figures

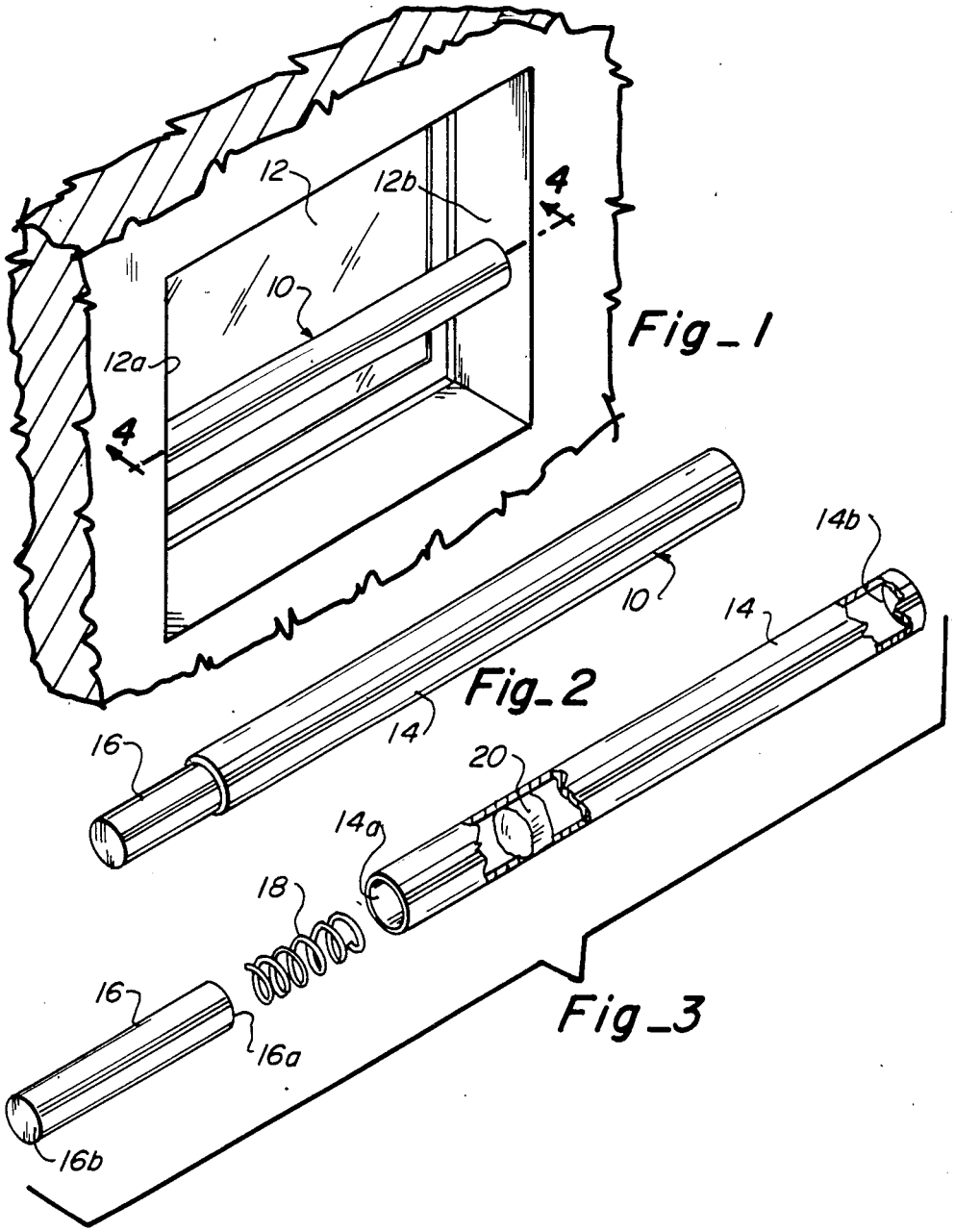
Fig_1
Fig_2
Fig_3
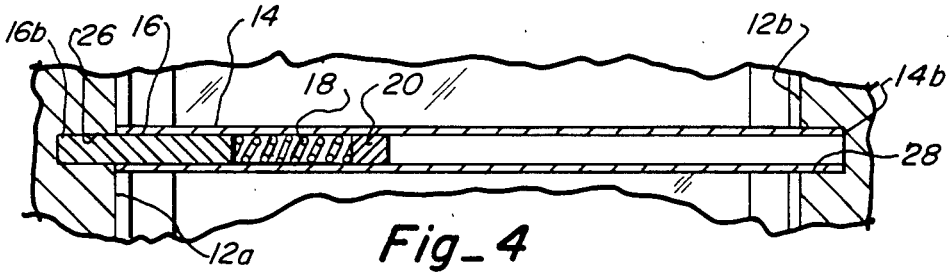
Fig_4

SECURITY BAR FOR WINDOW OPENING

BACKGROUND OF THE INVENTION

The present invention relates generally to security systems for building structures and more particularly to a security bar adapted to be fitted into a window opening or the like to partially restrict the pasage through the opening.

DESCRIPTION OF THE PRIOR ART

Security systems for homes and other building structures have taken many forms with a recent emphasis on electronic sensing systems which trigger an alarm when a circuit is closed, as by a window being broken, a pressure pad being touched or a light sensor being crossed. However, these systems are typically very expensive and beyond the financial means of most individuals.

Window openings are logical access locations for burglars or the like and, accordingly, one logical means for preventing entry through such an opening is by placing a bar across the opening to make the passage smaller and small enough so that most human beings could not pass through the opening. The installation of such a bar to restrict the opening, however, has in the past necessitated installation during the construction of the building or has necessitated a total replacement of the window and window frame to accommodate a permanently and securely installed bar.

SUMMARY OF THE INVENTION

The present invention is directed to a security system of the type wherein window openings and the like are partially restricted by a bar member extending across the window opening with the system being adapted to be a retrofit unit, readily installable in any window opening, and once installed will have the appearance of a bar which is part of the original window structure.

The security bar of the present invention includes an elongated tube which is approximately equal in length to the distance between opposing window frame members in which the bar is to be mounted and wherein recesses are provided in the opposing frame members for receiving opposite ends of the security bar. The tube includes a slidable rod in one end, which is biased outwardly by a resilient member retained inside the tube and wherein a stop is fixed internally of the tube to form a seat against which the resilient means can react when biasing the rod axially out of the associated open end of the tube.

The recesses in the opposing frame members in one embodiment are of different sizes with the recess on one frame member being adapted to matingly receive one end of the tubular member while the recess in the opposite frame member is of a smaller size and is adapted to matingly receive the slidable rod which is adapted to selectively project out of the opposite end of the tube. It will be appreciated with the detailed description hereinafter that the protective bar of the present invention can be easily retrofitted into any window opening by establishing appropriate recesses in opposing window frame members, inserting the tubular member into one of the recesses while depressing the slidable rod into the tube against the bias of the resilient member until the rod is aligned with the opposite recess, and then allowing the rod to be advanced into the opposite recess by the resilient member in the tube.

The stop against which the resilient member reacts, consists of a malleable material which is compressed axially, causing it to expand radially against the internal wall of the tube and be fixedly secured thereto at any desired location along the length of the tube by friction. The malleable material is merely inserted into one open end of the tube until it is positioned at the desired location and then compressed between two hard objects inserted into opposite ends of the tube until the axial compression causes a radial expansion of the malleable material causing it to engage the internal wall of the tube and through friction be positively positioned within the tube.

A second embodiment of the security bar is described in detail hereinafter and is adapted to be mounted in metal frame members having an open space therebehind whereas the first embodiment is adapted for use with thicker window frames such as of the type made of wood, concrete and the like.

In still another embodiment, means are provided for allowing the security bar to be readily removed from the window opening from a location in the interior of a building structure in the event the window opening was needed to facilitate an emergency escape from the structure.

Other aspects, features and details of the present invention can be more completely understood by reference to the following detailed description of a preferred embodiment, taken in conjunction with the drawings, and from the appended claims.

BRIEF DESCRIPTION OF THE DRAWINGS

FIG. 1 is a fragmentary perspective view of a window opening having a security bar of the present invention mounted therein.

FIG. 2 is a perspective view of the first embodiment of the security bar of the present invention.

FIG. 3 is an exploded perspective view of the security bar shown in FIG. 2 with parts removed for clarity.

FIG. 4 is an enlarged fragmentary section taken along line 4—4 of FIG. 1.

DESCRIPTION OF A PREFERRED EMBODIMENT

Figure 5:
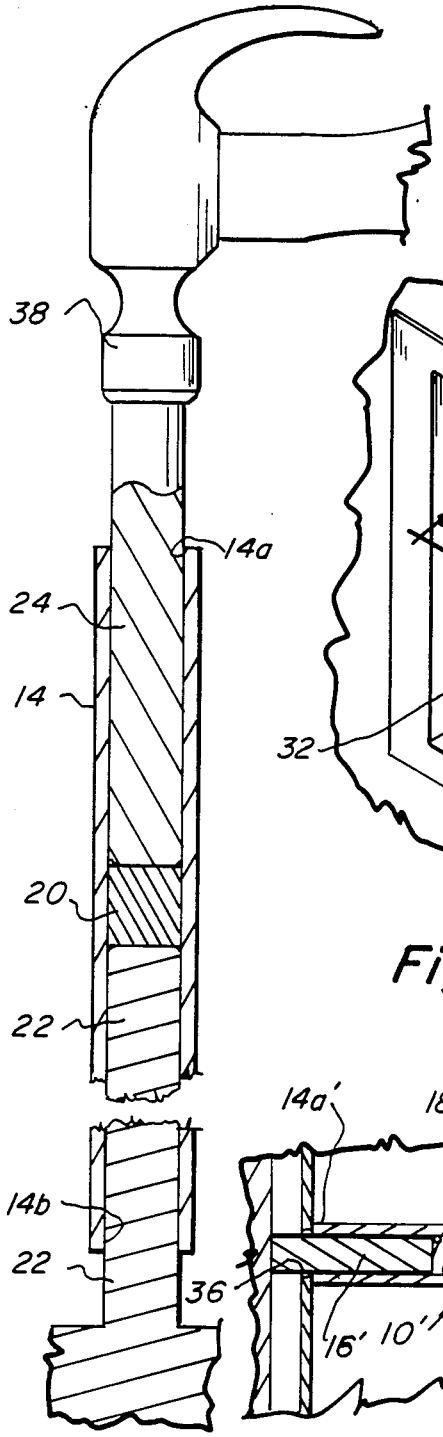
FIG. 5 is a longitudinal section of the tubular portion of the protective bar illustrating the manner in which the stop is positively positioned within the tubular member.
Figure 6:
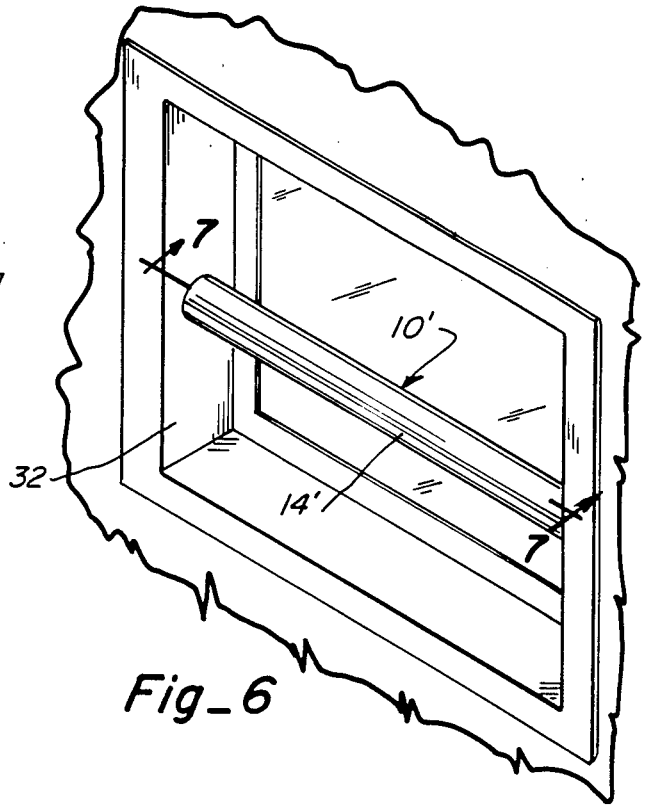
FIG. 6 is a fragmentary perspective view of a window opening having a second embodiment of the security bar of the present invention.
Figure 7:
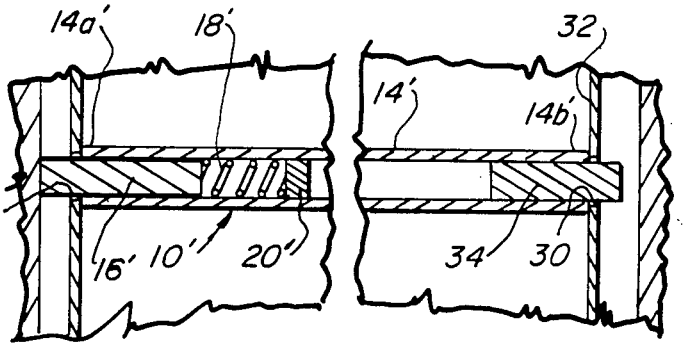
FIG. 7 is an enlarged section taken along line 7—7 of FIG. 6.

The security bar 10 of the present invention can be seen in FIG. 1 mounted in a window opening 12 and as will be appreciated from the description that follows, the security bar can be mounted in such an opening in a retrofit manner so that the window does not have to be reconstructed to install the bar nor is there any visible damage to the window resulting from installation.

The security bar 10 includes a tubular member 16 having opposite open ends **14*a* and 14*b* with a slidable insert rod 16 received in end 14*a* of the tube and biased outwardly by a resilient spring type element 18. The spring type element reacts against a stop member 20 formed from a malleable material and fixedly positioned internally of the tube 14** in a manner to be described later.

The tubular member 14 is made of a hard material such as steel and its overall length, in the first embodiment of the present invention, is selected to be slightly greater than the distance between the window frame members 12*a* and 12*b* in which the security bar is to be mounted. The thickness and overall strength of the tube 14 can be determined by anyone skilled in the art, it only being important that the bar not be bendable under forces that could easily be applied by a burglar or the like at the window location.

The slidable insert rod 16 is also made of a strong material such as steel and while it could be tubular in form, it is preferably of aolid cross section having an outside diameter establishing a close sliding fit between the rod and the interior of the tubular member 14. The length of the rod 16 is not critically important but should be of a length so as to extend an adequate distance into the end 14*a* of the tube such that it will not easily pop out when a lateral force is applied to the security bar.

The spring type element 18 which biases the rod 16 axially outwardly of end 14*a* of the tubular member is a coil spring which is positioned between the innermost end 16*a* of the rod 16 and the stop 20. The spring 18 is designed such that the rod 16 can be urged inwardly against the bias of the spring until the outermost end 16*b* of the rod aligns with the associated end 14*a* of the tubular member for a purpose to be described later.

The stop 20, which forms a seat against which the spring 18 can react is made of a malleable material such as lead, cork, or some deformable rubbers and plastics, and is positively positioned within the tubular member 14 by inserting a charge of malleable material into the tubular member through one open end thereof and moving the material until it is positioned at a desirable location along the length of the tube. Once it has been so positioned, a mandrel 22 or the like is inserted into one open end of the tubular member until it abuts the malleable material and a similar mandrel 24 is inserted through the opposite end until it engages the malleable material, and then the malleable material is compressed axially between the mandrels by applying successive blows to one of the mandrels, as with a hammer, causing the malleable material to expand radially into tight frictional engagement with the interior surface of the tubular member 14. Once the malleable material has been expanded and set in place within the tubular member, the mandrels 22 and 24 can be removed, the spring member 18 inserted, and seated against the stop 20, and finally the slidable rod 16 inserted into the adjacent open end 14*a* of the tubular member to engage the spring member.

The longitudinal location of the stop 20 as mentioned previously, is not critical, but should be positioned an adequate distance from the adjacent open end 14*a* of the tubular member so that the rod will remain inside the tubular member even when lateral forces are applied to the tubular member. The length of the rod should be correlated with the positioning of the stop 20, however, so that under normal circumstances, the rod will protrude from the end 14*a* of the tubular member a short distance but can be compressed against the bias of the spring 18 until the outermost end of the rod 16*b* is contiguous with the end 14*a* of the tubular member.

To install the security bar 10 of the present invention in an existing window opening, recesses 26 and 28 are respectively provided in opposite frame members 12*a* and 12*b* of the window to receive the security bar. The recesses 26 and 28 are of different sizes with the recess 26 in frame member 12*a* being of a size to matingly receive end 14*b* of the tubular member 14, and the recess 28 in the opposite frame member 12*b* being of a size to matingly receive the slide rod 16 which protrudes from the opposite end 14*a* of the tubular member. In the case of the first disclosed embodiment, the recesses are of circular cross sectional configuration to conform with the circular cross section of both the tubular member 14 and the rod 16. The depth of the recess 26 which receives the first end 14*b* of the tubular member 14 is predetermined and correlated with the length of the tubular member so that when the tubular member is inserted into the recess, the opposite end 14*a* of the tubular member will be contiguous with the opposite frame member 12*b* of the window opening. The second recess 28 would not have to be any particular depth, but in the preferred embodiment, recesses which are ¾ of an inch deep have proved adequate.

Figure 8:
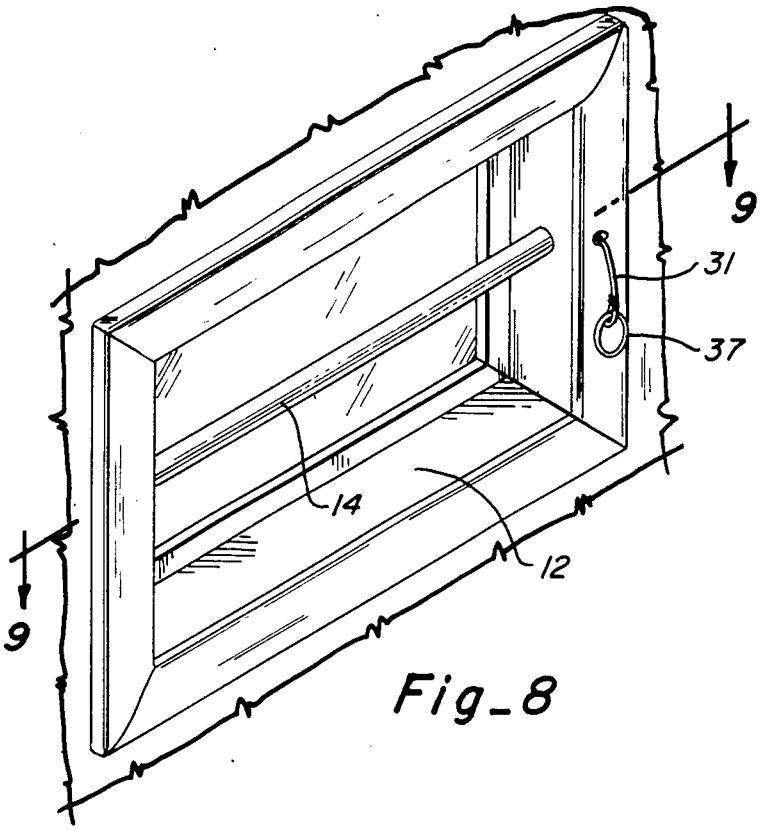
FIG. 8 is a fragmentary perspective view of a window opening similar to FIG. 1 illustrating an addition to the security bar shown in FIG. 1.
Figure 9:
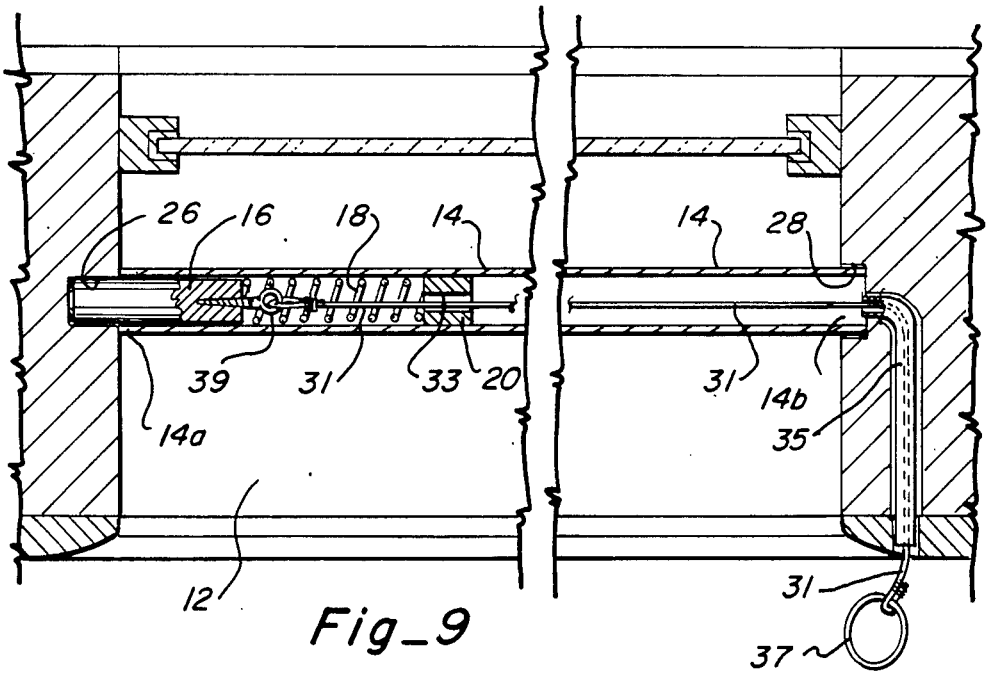
FIG. 9 is a fragmentary section similar to FIG. 4 illustrating the addition shown in FIG. 8.

To satisfy certain building codes, a security bar of the type disclosed hereinabove needs to be readily removable from a location in the interior of the building structure in which the security bar is mounted in the event an emergency escape from the building is necessary. To satisfy such a code, an addition to the security bar 10 described is illustrated in FIG. 8 which enables the rod 16 to be retracted enough to release the security bar from its anchored relationship with the window frame.

In order to retract the rod 16, a pull cable 31 is connected to the inner end of the rod 16 with the cable passing axially through the center of the coil spring 18, a hole 33 drilled through the plug 20, and subsequently through the open end 14*b* of the tubular member 14 wherein the cable passes into a sheath 35 which is embedded in a passageway provided through the window frame to a location on the interior of the building structure. The end of the pull cable, which is located in the interior of the building structure, could have a ring 37 or other such means on the end thereof so that an individual in the building structure could grasp the ring and pull it, causing the rod 16 to retract against the bias of the spring 18 until it had been removed from the recess 26 allowing the security bar to be pushed out of its anchored relationship with the window frame. As will be appreciated, this could be done in a very rapid manner so that even under emergency situations, an individual could remove the security bar with very little thought or effort and allow himself to escape through the window opening. The pull cable could be anchored to the inner end of the rod 16 in any suitable manner, one means being an eye screw 39 which is threaded into the inner end of the rod, and has a circular eyelet to which the cable could be easily attached. The hole 33 through the plug 20 would be provided by a drill after the plug was set in place in the manner hereinbefore described.

The above description of the invention, with or without the pull cable system, is utilized when the security bar 10 is to be mounted in a wooden, brick, concrete or other such solid window frame, but when the security bar is to be mounted in a steel window frame, which has a relatively thin thickness and a void space behind it, a modified form ot the security bar is utilized. In the description of the modified form, like parts have been given like reference numerals with a prime suffix.

The modified form 10' of the security bar is necessary since metal window frames are not thick enough to be recessed as are wood frames and accordingly a complete hole through the metal frame rather than a recess is required. The end **14*b* of the first described tubular member 14, once inserted into such a hole, will not be restricted from further axial movement and accordingly a system needs to be employed to prevent such further axial movement. Accordingly, to positively position the first end 14*b'* of the tubular member when a thin metal window frame is present, a rod 34, similar to the slidable rod 16 of the first embodiment, can be inserted into the open end 14*b'* of the tubular member and positively positioned therein as with epoxy or the like so that the rod 34 protrudes out of the open end of the tubular member a slight distance such as approximately ¾ of an inch. A hole 30 provided in the window frame would be equivalent in diameter to the outside diameter of the rod 34 so that the rod can be inserted into the hole 30 allowing the adjacent end 14*b'* of the tubular member 14' to abut the window frame 32 to prevent any further axial movement of the tubular member through the window frame. In this embodiment the overall length of the tubular member 14' would be equal to the distance between the two opposing frame members so that after the first end 14*b'* of the tubular member is positioned in the window frame, the opposite end 14*a'* of the tubular member would be contiguous with the opposite window frame member. The opposite end of the security bar 10' is then anchored in a hole 36 in the opposite frame member in a manner similar to that described in connection with the first described embodiment by inserting a slide rod 16' in hole 36 under the bias of a spring 18' reacting against a stop 20'**.

Of course, a pull cable release system of the type described hereinbefore in connection with the first described embodiment could also be employed in the second described embodiment. A detailed description is not felt necessary as one skilled in the art could easily apply the teachings described in connection with the first embodiment to the second embodiment.

It will therefore be appreciated that with the security bar of the present invention, window type openings can be modified to prevent burglars or the like from entering a building structure through that window by restricting the size of the opening through the window. Also, as will be appreciated, and as mentioned previously, the bar can be mounted in the window opening in a retrofitted fashion without causing visible damage to the window and once the security bar has been mounted, it appears externally to be an integral part of the window frame.

Although the present invention has been described with a certain degree of particularity, it is understood that the present disclosure has been made by way of example, and changes in detail or structure may be made without departing from the spirit of the invention, as defined in the appended claims.

What is claimed is:

1. A security bar for restricting passage through a window type opening having a pair of opposed frame members on opposite sides thereof and with a hole in each frame member comprising in combination:

a cylindrical tube of rigid material having a length approximating the distance between said opposite frame members of the opening, one end of said tube adapted to be received in the hole in one of said frame members, the opposite end of said tube having an axially slidable cylindrical insert adapted to project into the other of said holes, a coil spring member positioned internally of said tube and adapted to bias said insert axially outwardly of the tube, and a stop fixed internally of the tube against which the coil spring member can react, said stop being made of a malleable material and being frictionally retained in place by axial compression of the malleable material which causes radial expansion into a tight friction fit with the interior of the tube.

* * * * *